US007591328B2

(12) United States Patent
Guede

(10) Patent No.: US 7,591,328 B2
(45) Date of Patent: Sep. 22, 2009

(54) DRILLING AND ANCHOR SETTING TOOL

(75) Inventor: Dieter Guede, Marl (DE)

(73) Assignee: Hilti Aktiengesellschaft, Schaan (LI)

( * ) Notice: Subject to any disclaimer, the term of this patent is extended or adjusted under 35 U.S.C. 154(b) by 255 days.

(21) Appl. No.: 11/600,489

(22) Filed: Nov. 15, 2006

(65) Prior Publication Data

US 2007/0114070 A1 May 24, 2007

(30) Foreign Application Priority Data

Nov. 21, 2005 (DE) ..... 10 2005 000 158

(51) Int. Cl.
*E21B 3/02* (2006.01)
*E21D 20/02* (2006.01)

(52) U.S. Cl. ..... 175/118; 405/259.5; 405/269

(58) Field of Classification Search ..... 175/118, 175/315, 403; 405/248, 233, 269, 253
See application file for complete search history.

(56) References Cited

U.S. PATENT DOCUMENTS 3,986,536 A * 10/1976 Janson ..... 141/311 R
5,342,149 A * 8/1994 McCabe et al. ..... 405/269
6,491,478 B2 * 12/2002 Sager et al. ..... 405/259.6
6,793,445 B1 * 9/2004 Charlton et al. ..... 405/259.5
7,338,234 B2 * 3/2008 Rataj et al. ..... 405/259.6
2007/0086862 A1 * 4/2007 Koehler ..... 405/259.5

FOREIGN PATENT DOCUMENTS

DE 19700701 A1 * 7/1998
JP 357096119 A1 * 6/1982
JP 402058623 A1 * 2/1990

* cited by examiner

*Primary Examiner*—Kenneth Thompson
(74) *Attorney, Agent, or Firm*—Abelman, Frayne & Schwab

(57) ABSTRACT

A drilling and anchor-setting tool (1) for mine, tunnel, and underground works for setting an anchor (5) in a borehole and provided with a core bit and with single-or multi-component adhesive mass (6), with the tool including a housing (2) having a chamber (4), and an extrusion device (3) for forcing the adhesive mass (6) out of the anchor (5) when the anchor (5) is located in the borehole, and integrated in the housing chamber (4).

9 Claims, 3 Drawing Sheets

DRILLING AND ANCHOR SETTING TOOL

BACKGROUND OF THE INVENTION

1. Field of the Invention

The present invention relates to a drilling and anchor-setting tool for mine, tunnel, and underground works for setting an anchor in a borehole and provided with a core bit and with single-or multi-component adhesive mass, with the tool including an extrusion device for forcing the adhesive mass out of the anchor when the anchor is located in the borehole.

2. Description of the Prior Art

In mine, tunnel and underground works, anchors are primarily set in boreholes which were formed beforehand with special drill pipes. In order to achieve a better fixation of an anchor in solid, additionally an adhesive mass is used. Primarily, a single- or two-component adhesive mass which upon destruction of a suitable vessel, come into contact with each other, when the adhesive mass contains more than one component, is used. The adhesive mass is hardened on site at a location, simultaneously securing the anchor. The drawback of this solution consists in that expenses are particularly high when firstly, a borehole is formed and then, in a following step, the anchor is brought in, which requires resetting of the drill platform. For these reasons, there is provided an anchor having a drill crown at its borehole end and performing a double function of a drill and anchor. This anchor is also equipped with an extrusion device that includes a container filled with an adhesive mass. After the anchor reached its end position in the borehole, a piston applies a pressure force to the container, which is filled with the adhesive mass, to force the adhesive mass from the container. Such an extrusion device is disclosed, e.g., in German Publication DE-OS 103 34 374. The extrusion device is integrated in a unit which is positioned in front of the drilling and anchor-setting tool. This results in a relatively large length of the drilling and anchor-setting tool that makes handling of the tool difficult in narrow place confines.

Accordingly, an object of the present invention is a drilling and anchor-setting tool for mine, tunnel and underground works and including an extrusion device for forcing an adhesive mass from an anchor equipped with a drill crown, with the tool having a reduced length, which makes the tool easily maneuverable and capable of being used also in narrow place confines.

SUMMARY OF THE INVENTION

This and other objects of the present invention, which will become apparent hereinafter, are achieved by integrating the extrusion device in a chamber provided in the housing of a drilling and anchor-setting tool.

The chamber is located at the borehole end of the drilling and anchor-setting tool and serves, among others, for receiving the extrusion device. Therefore, advantageously, minimum space is required for the drilling and anchor-setting tool.

This is particularly the case when the chamber is formed in the drill shaft, being integrated therein. To this end, the drill shaft has, at the borehole end of the drilling and anchor-setting tool, a corresponding chamber-shaped widening.

A further place saving is achieved when a flushing device is formed as a flushing head and is located, viewed in a drilling direction, behind the housing and opens into the housing chamber. The chamber has, to this end, a matching opening at its end remote from a borehole and in which the flushing head is secured from the rear side of the drilling and anchor-setting tool. The drill shaft is formed as a two-stage part. In its borehole end, there is provided the chamber with the extrusion device received therein, and at its end remote from the borehole, a connection for the flushing head is located. Thus, there is no need to provide a separate unit consisting of extrusion and flushing devices and to install it in front of the drilling and anchor-setting tool. Thus, the space, which is required for such a separate unit is saved as a result of integration of the extrusion device in the housing and of attachment of the flushing head to the housing.

It is further contemplated to arrange a sleeve in the housing chamber with a possibility of displacement in the direction of the drilling axis. The sleeve serves for additional fixation of the anchor in the solid and which has an outer profile corresponding to the inner profile of the chamber. Advantageously, this is the case with a round sleeve.

In addition, the sleeve is displaceable against a biasing force of a spring, being axially supported by the spring against an inner wall of the chamber.

According to an advantageous embodiment of the invention, the sleeve is provided in a region of its outer profile with openings for limiting a displacement path of the sleeve. The openings can be formed, e.g., as elongated holes. For limiting the displacement path, bolts are used and which are engaged by respective ends of the elongate holes in respective and positions of the sleeve.

Preferably, the openings have different lengths. Thus, over its circumference, the sleeve has openings with different lengths among which is an opening the diameter of which corresponds to the bolt dimensions for preventing displacement in the corresponding position of the sleeve, if needed. In this way it is possible, e.g., to position the sleeve in the chamber with an offset of 90° or 100° about its longitudinal axis dependent on what and if any displacement of the sleeve in the chamber needs be achieved.

According to a particular advantageous embodiment of the invention, a pressure plate is provided at a rear, viewed in a drilling direction, end of the housing chamber, which, among other, serves as a stop for the sleeve.

The other function of the pressure plate is to serve as a support for an anchor sleeve that surrounds the anchor tube and to serve as a guide for the flushing liquid.

The pressure plate itself can form a guide for the flushing liquid. To this end, the pressure plate is arranged in the region of a flushing tube connecting the flushing head with the chamber and has in this region an opening for the flushing tube.

Finally, the pressure plate is so formed and positioned that it absorbs axial forces generated during the drilling process. The pressure plate has projections extending toward the borehole end of the chamber for retaining apart separate units arranged in the chamber.

In connection with its numerous functions, namely, supporting the anchor sleeve, guiding the flushing liquid, absorbing the axial force, the pressure plate is subjected to particular high forces, which can result in an increased wear. Therefore, the pressure plate is formed as a separate replaceable part.

As it has already been mentioned above, the pressure plate functions as a guide for the flushing liquid. In order to be able to perform this function, the pressure plate is sealed relative to the chamber in the axial and/or radial direction. This prevents passing of the flushing liquid between the sleeve and the pressure plate.

The pressure plate is located between a chamber wall, which is formed by a drill shaft, and the sleeve. The pressure plate is so formed that an inner surface of the pressure plate, which extends transverse to a drilling axis, has smaller dimensions than an outer surface of the pressure plate at an end of the pressure plate remote from the borehole. With the outer surface of the pressure plate being larger than the inner surface, it is insured that the pressure plate remains in its predetermined position because the pressure, which is applied by the flushing liquid to the side of the pressure plate remote from the borehole, generates pressure forces that are greater than lifting forces acting on the inner surface of the pressure plate.

An essential advantage of the invention consists in a relatively smaller length of the drilling and anchor-setting tool. This is achieved, on one hand, by providing a chamber in the tool or the drill shaft, which is, thus, integrated in the tool and, on the other hand, by mounting the flushing head on the rear side of the housing in such a manner that practically no additional space is required. In order to insure this, the flushing head is connected with the housing of the drilling and anchor-setting tool by screw connection means. This also insures a particularly easy replacement of the flushing device.

In order to be able to use the inventive drilling and anchor-setting tool also within narrow confines, the flushing head is formed with a length that approximately corresponds to the length of the tool housing. As to the tool length, it also includes the axial length of the hydraulic motor mounted on the rear wall of the housing. In the inventive drilling and anchor-setting tool, the hydraulic motor projects past the rear wall as far as the flushing head projects.

An advantageous embodiment of the flushing head has at least two flushing channels. With the flushing head, both central flushing and outer flushing are used. About the central port, there are provided several annular bores for a second flushing medium. For separating the two channels, the already mentioned anchor sleeve is used.

The invention is characterized in particular in that it is provide a drilling and anchor-setting tool for mine, tunnel and underground works capable of being used in very narrow places, with the extrusion device for an anchor, which is securable with adhesive and includes a bore bit, being completely integrated in the tool. This integration is achieved, on one hand, by positioning the extrusion device in a chamber which is provided at a borehole end of the tool and is integrated in the drill shaft. On the other hand, the flushing head opens into the chamber from the rear side of the housing. The chamber is thus located directly in the housing, and the flushing head is so secured at the rear wall of the housing that it would practically be accommodated only in the space necessary for the hydraulic motor. A particular important component of the invention is a pressure plate provided at the end of the chamber remote from the borehole and performing three functions. The pressure plate, in addition to its sealing function in the axial and/or radial direction, also serves for supporting the anchor sleeve and for absorbing axial force generated by drilling.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

Figure 1:
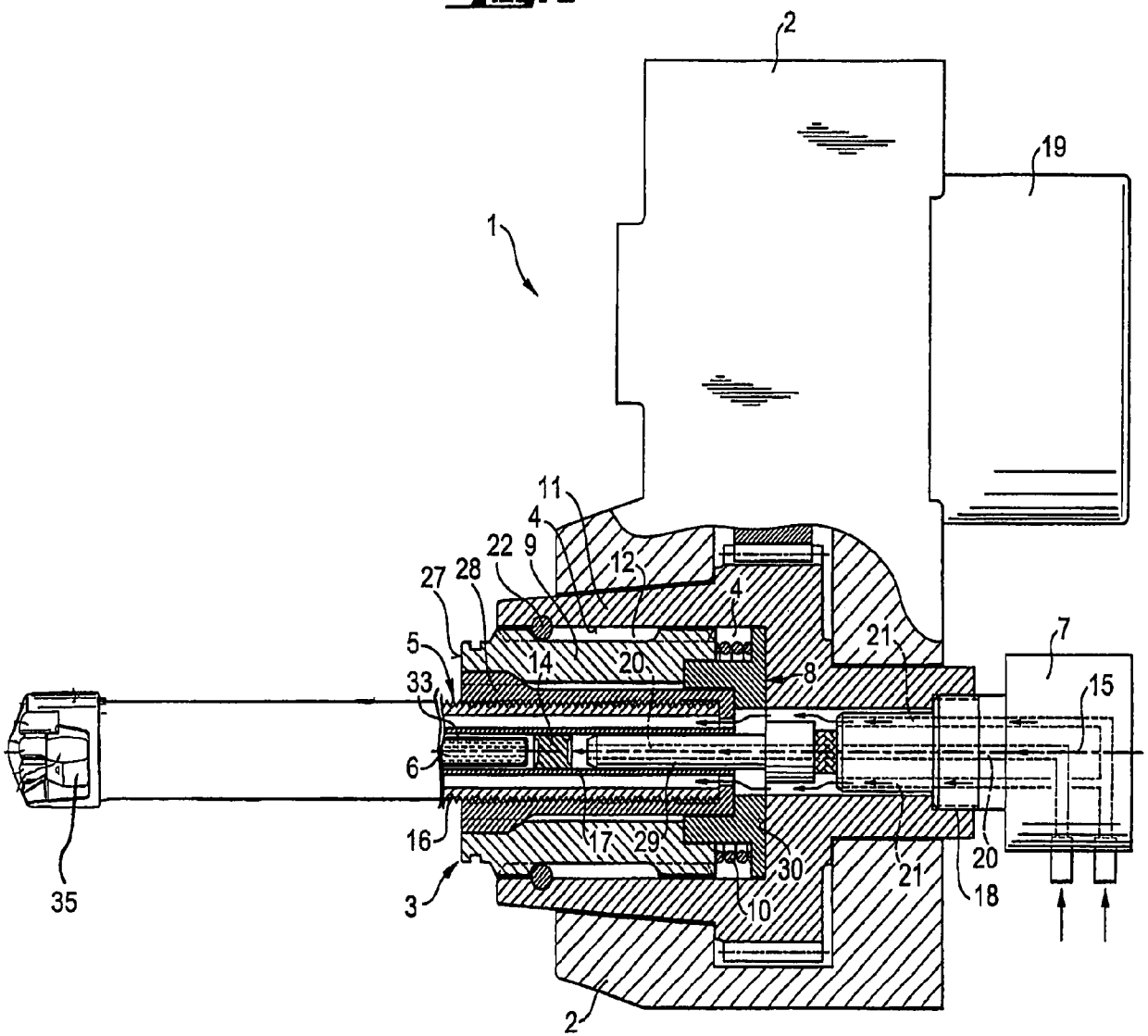
FIG. 1 a schematic, partially cross-sectional view of a drilling and anchor-setting tool according to the present invention.

A drilling and anchor-setting tool 1 according to the present invention, which is shown in FIG. 1, has a housing 2 having, at its end 27 adjacent to a borehole, a chamber 4, a core bit 35, and a hydraulic motor 19 for driving the core bit 35. In the chamber 4, an extrusion device 3 is located. The extrusion device 3 includes a reservoir 33 which is filled with adhesive mass 6 and is subjected to action of a piston 14 as soon as anchor 5 or an anchor tube 16 reaches its end position in the borehole and should be additionally secured therein with the adhesive mass 6. In the chamber 4, which is located in a drill shaft 11, a sleeve 9 displaceable in the direction of a drill axis 15, is located. The displaceable sleeve 9 serves for additional mechanical protection of the anchor, if necessary. In the sleeve 9, an anchor nut 28 is located. The sleeve 9 is displaceably supported against a spring 10, and the anchor nut 28, which is fixedly connected with the sleeve 9, is screwed upon displacement of the sleeve 10. An anchor sleeve 17 partially surrounds a flushing tube 29. Both the anchor sleeve 17 and the sleeve 9 are supported, if necessary, against a pressure plate 8 which is provided at an end 30 of chamber 4 remote from the borehole. The pressure plate 8 serves further for diverting the flushing liquid and as a seal. From the rear, a flushing device, which is formed as flushing head 7 opens into the chamber 4. The flushing head 7 is secured in the housing 2 and over the drill shaft 11 by means of a threaded connection 18 and, thus, can be comparatively easily released. The flushing head 7 has a central flushing channel 20 provided in the flushing tube 29, and outwardly located flushing channels 21.

Figure 2:
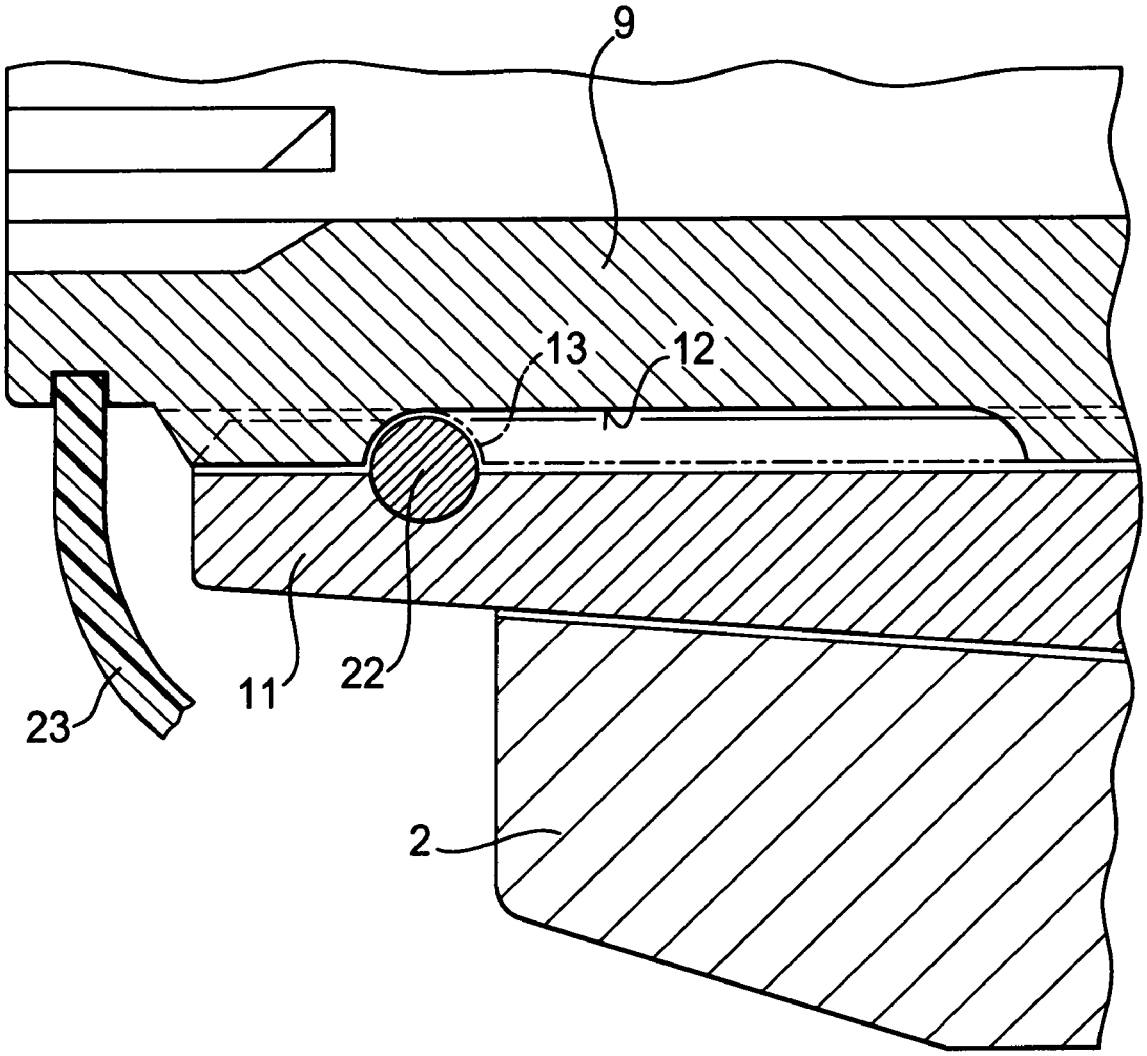
FIG. 2 a partial, cross-sectional view of a protective sleeve with openings.

FIG. 2 illustrates the function of the openings in the outer wall of the sleeve 9. In FIG. 2, two openings 12 and 13 are shown. The first opening 12 is formed as an elongate opening. The second opening 13 is formed so that it corresponds to a bolt 22 in order to prevent any backlash of the sleeve 9 in the housing 2 which is additionally sealed with a seal 23.

Figure 3:
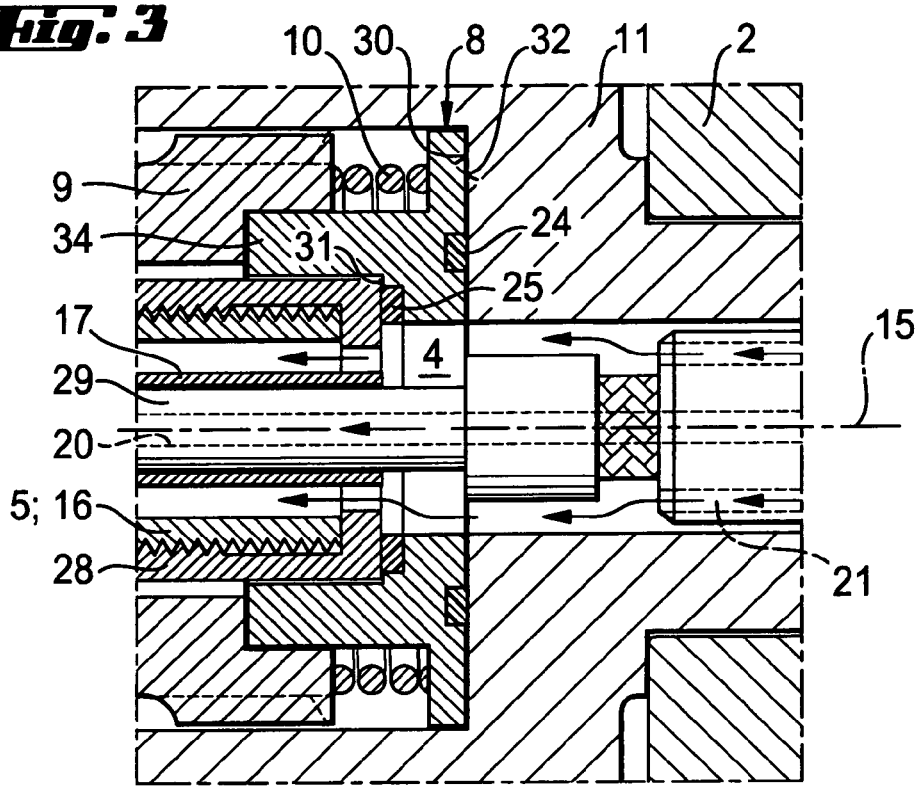
FIG. 3 a cross-sectional view of a pressure plate of the tool sealed in axial direction.

FIG. 3 shows the pressure plate 8 that is sealed with a seal 24 with respect to the drill shaft 11. On the borehole inner surface 31 of the pressure plate 8, there is provided an axial seal 25. The borehole inner surface 31 has smaller dimensions than the outer surface 32 at the pressure plate end remote from the borehole. The sleeve 9 is displaceable relative to the pressure plate 8 in the direction of the drill axis 15. As it has already been discussed above, the sleeve 9 is supported against the pressure plate 8 by a spring 10.

Figure 4:
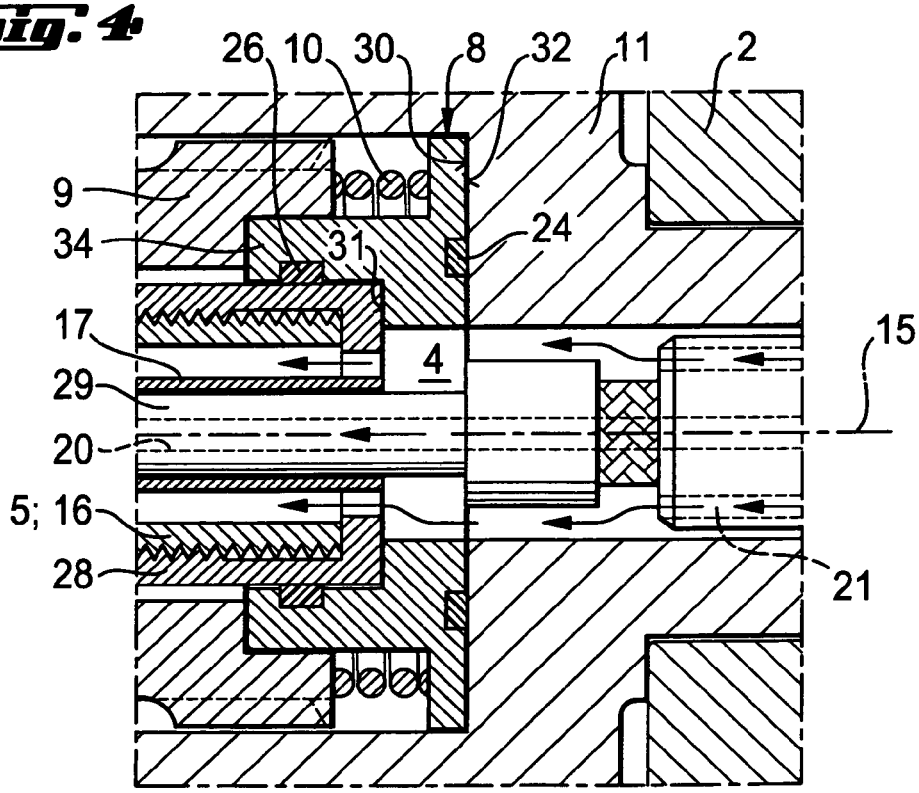
FIG. 4 a cross-sectional view of the pressure plate sealed in radial direction.

FIG. 4 shows the pressure plate 8 which is sealed radially with respect to the drill shaft 11 by a radial seal 26. The pressure plate 8 is provided on its borehole inner surface 31 with a projection 34 to securely position the radial seal 26.

All of the features, including those shown only in the drawings, should be considered essential to the invention whether taken alone or in combination.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A drilling anchor-setting tool (1) for mine, tunnel, and underground works for setting an anchor (5) in a borehole and provided with a core bit and with a single- or multi-component adhesive mass (6), the drilling and anchor-setting tool comprising a housing (2) having a chamber (4); an extrusion device (3) for forcing the adhesive mass (6) out of the anchor (5) when the anchor (5) is located in the borehole, and integrated in the housing chamber (4); a sleeve (9) located in the housing chamber (4) and displaceable in a direction of a drilling axis (15); and spring means (10) for biasing the sleeve (9) in a direction opposite a displacement direction of the sleeve (9).

2. A drilling and anchor-setting tool according to claim 1, wherein the sleeve (9) is provided in a region of an outer profile thereof with openings (12, 13) for limiting a displacement path of the sleeve (9).

3. A drilling and anchor-setting tool according to claim 2, wherein the openings (12, 13) have different lengths.

4. A drilling anchor-setting tool (1) for mine, tunnel, and underground works for setting an anchor (5) in a borehole and provided with a core bit and with a single- or multiple-component adhesive mass (6), the drilling and anchor-setting tool comprising a housing (2) having a chamber (4); an extrusion device (3) for forcing the adhesive mass (6) out of the anchor (5) when the anchor (5) is located in the borehole, and integrated in the housing chamber (4); and a pressure plate (8) provided at a rear, viewed in a drilling direction, end (30) of a housing chamber (4) and serving for absorbing axial forces generated during a drilling process.

5. A drilling and anchor-setting tool according to claim 4, wherein the pressure plate (8) supports an anchor sleeve (16) that surrounds an anchor tube (17).

6. A drilling and anchor-setting tool according to claim 4, wherein the pressure plate (8) forms a guide for the flushing liquid.

7. A drilling and anchor-setting tool according to claim 4, wherein the pressure plate (8) is formed as a separate, replaceable component.

8. A drilling and anchor-setting tool according to claim 4, wherein the pressure plate (8) is sealed with respect to the housing chamber (4) at least in one of radial direction and axial direction.

9. A drilling and anchor-setting tool according to claim 4, wherein an inner surface (31) of the pressure plate (8), which extends transverse to a drilling axis (15), has smaller dimensions than an outer surface (32) of the pressure plate (8) at an end of the pressure plate (8) remote from the borehole.

* * * * *